US011821237B2

(12) United States Patent
Hickman

(10) Patent No.: US 11,821,237 B2
(45) Date of Patent: Nov. 21, 2023

(54) CYLINDRICAL LEVER LOCKING SYSTEM

(71) Applicant: dormakaba USA Inc., Indianapolis, IN (US)

(72) Inventor: Chad A. Hickman, Indianapolis, IN (US)

(73) Assignee: dormakaba USA Inc., Indianapolis, IN (US)

( * ) Notice: Subject to any disclaimer, the term of this patent is extended or adjusted under 35 U.S.C. 154(b) by 0 days.

(21) Appl. No.: 17/499,520

(22) Filed: Oct. 12, 2021

(65) Prior Publication Data

US 2022/0112743 A1 Apr. 14, 2022

Related U.S. Application Data

(60) Provisional application No. 63/091,670, filed on Oct. 14, 2020.

(51) Int. Cl.

| | |
|---|---|
| ***E05B 55/00*** | (2006.01) |
| ***E05B 59/00*** | (2006.01) |
| ***E05B 63/00*** | (2006.01) |
| ***E05B 47/00*** | (2006.01) |

(52) U.S. Cl.

CPC ..... *E05B 55/005* (2013.01); *E05B 47/0001* (2013.01); *E05B 59/00* (2013.01); *E05B 63/0056* (2013.01); *E05B 2047/0024* (2013.01)

(58) Field of Classification Search

CPC ..... E05B 55/00; E05B 55/005; E05B 47/00; E05B 47/0001–0005; E05B 2047/0024; E05B 2047/0025; E05B 59/00; E05B 63/056

USPC ..... 70/224

See application file for complete search history.

(56) References Cited

U.S. PATENT DOCUMENTS

| | | | | |
|---|---|---|---|---|
| 2014/0165677 | A1* | 6/2014 | Hickman | E05B 47/0012 70/277 |
| 2014/0191516 | A1* | 7/2014 | Badhya | E05B 55/005 292/145 |
| 2019/0136581 | A1* | 5/2019 | Barker | E05B 17/048 |

* cited by examiner

*Primary Examiner* — Nathan Cumar

(74) *Attorney, Agent, or Firm* — Faegre Drinker Biddle & Reath LLP

(57) ABSTRACT

A cylindrical door lock including a latch bolt, a cam assembly operable to move the latch bolt from a first position to a second position, a support at least partially surrounding the cam assembly, an operator actuatable input device operatively coupled to the latch bolt through the cam assembly, a retainer coupling the operator actuatable input device to the support and being moveable between a hold position and a remove position, a removable lock core positioned at least partially within the operator actuatable input device, a throw member operatively coupled with the lock core and the cam assembly to actuate the cam assembly based on a position of the operator actuatable input device, and a stabilizer positioned at least partially within the support and posterior to the lock core.

19 Claims, 9 Drawing Sheets

CYLINDRICAL LEVER LOCKING SYSTEM

RELATED APPLICATION

This application claims the benefit of U.S. Provisional Patent Application Ser. No. 63/091,670, filed Oct. 14, 2020, titled CYLINDRICAL LEVER LOCKING SYSTEM, the entire disclosure of which is expressly incorporated by reference.

FIELD

The present disclosure relates to door locks with removable cores. More specifically, the present disclosure includes a stabilizer for stabilizing a throw member within the door lock.

BACKGROUND

Interchangeable cores can be used for door locks in applications in which re-keying is regularly needed. Interchangeable cores can be removed and replaced with alternative interchangeable cores actuated by different keys, including different keys of the same format or different keys using alternative key formats such as physical keys and access credentials such as smartcards, proximity cards, key fobs, cellular telephones and the like.

SUMMARY

The present disclosure provides lock indicators useable to signal the locked or unlocked state of a lock at one or both sides of a door selectively secured by the lock. Throughout this document, "inside" will be used to reference the side of a door and lock actuator available to occupants of an area secured by the lock, while "outside" will be used to reference the side of a door and lock actuator available to those seeking ingress to the secured area.

In an exemplary embodiment of the present disclosure, a cylindrical door lock is provided, the cylindrical door lock comprising: a latch bolt moveable between a first position operable to limit ingress and egress and a second position operable to permit ingress and egress; a cam assembly operable to move the latch bolt from the first position to the second position; a support at least partially surrounding the cam assembly; an operator actuatable input device having an open end, the support being received in the open end, the operator actuatable input device being operatively coupled to the latch bolt through the cam assembly to transition the latch bolt from the first position to the second position; a retainer coupling the operator actuatable input device to the support, the retainer being moveable between a hold position wherein the operator actuatable input device is coupled to the support and a remove position wherein the operator actuatable input device is translatable relative to the support; a removable lock core positioned at least partially within the operator actuatable input device; a throw member operatively coupled with the lock core and the cam assembly to actuate the cam assembly based on a position of the operator actuatable input device; and a stabilizer positioned at least partially within the support and posterior to the lock core.

In an example thereof, the retainer includes a central opening, a portion of the body of the stabilizer being positioned in the central opening of the retainer.

In a further example thereof, the retainer supports the body of the stabilizer such that the throw member is maintained in a predetermined orientation.

In a further example thereof, the throw member and the stabilizer extend through the central opening and the throw member and the stabilizer are operable to rotate about a longitudinal axis within the central opening.

In a further example thereof, the stabilizer includes a bushing including a central aperture, the bushing operable to receive at least a portion of the stabilizer in the central aperture.

In a further example thereof, the body of the stabilizer includes a first portion and a second portion, the first portion having first diameter and the second portion having a second diameter, the first portion operable to be positioned in the central aperture of the bushing and the second portion operable to be positioned in the central opening of the retainer.

In a further example thereof, the stabilizer, including the bushing, and at least a portion of the throw member are operable to be positioned between the lock core and the retainer.

In a further example thereof, the stabilizer, including the bushing, and the throw member substantially fill an interior of the support at a cross section of the support at a longitudinal position between the lock core and the retainer.

In a further example thereof, the bushing of the stabilizer engages with the support so as retain the throw member along a longitudinal axis during assembly of the cylindrical door lock.

In a further example thereof, the stabilizer is operable to retain the throw member in a predetermined configuration to engage the lock core when the lock core is installed.

In an example thereof, the stabilizer is operable to provide mechanical resistance against movement of the retainer from the engaged position to the disengaged position.

In an example thereof, the stabilizer includes a body operable to be positioned to contact the retainer.

In an exemplary embodiment of the present disclosure, a stabilizer for a cylindrical door lock mounted to a door is provided, the cylindrical door lock including a support, an operator actuatable input device at least partially surrounding the support, a retainer being moveable between an engaged position in which the retainer engages the support and the operator actuatable input device to limit axial translation of the operator actuatable input device relative to the support and a disengaged position in which the retainer permits axial translation of the operator actuatable input device relative to the support, a removable lock core positioned at least partially within the operator actuatable input device, a latch bolt moveable between an engaged position operable to limit ingress and egress and a disengaged position operable to permit ingress and egress, and a cam assembly operable to transition the latch bolt between the engaged position and the disengaged position, the stabilizer comprising: a body operable to be positioned at least partially within the support and posterior to the lock core, the body being further operable to provide mechanical resistance against the retainer to limit movement of the retainer from the engaged position to the disengaged position.

In an example thereof, the stabilizer further comprises a throw member extending from the body, the throw member operable to engage with the lock core and the cam assembly, the throw member operable to transmit user input received at the lock core to the cam assembly.

In a further example thereof, the throw member and the body are formed as an integral unit.

In a further example thereof, the body is bonded to the throw member.

In a further example thereof, the stabilizer further comprises a bushing including a central aperture, the bushing operable to receive at least a portion of the stabilizer in the central aperture.

In a further example thereof, the bushing, the body, and at least a portion of the throw member are operable to be positioned between the lock core and the retainer.

In a further example thereof, the bushing, the body, and the throw member substantially fill at least a portion of an interior space formed in the support at a longitudinal position between the lock core and the retainer.

In a further example thereof, the bushing is shaped to engage an interior surface of the support when positioned in the interior space of the support, the bushing and the body retained within the support such that the throw member is maintained in a predetermined orientation to engage the lock core when the lock core is installed.

BRIEF DESCRIPTION OF THE DRAWINGS

The above-mentioned and other features and advantages of this disclosure, and the manner of attaining them, will become more apparent and will be better understood by reference to the following description of exemplary embodiments taken in conjunction with the accompanying drawings, wherein.

Corresponding reference characters indicate corresponding parts throughout the several views. The exemplification set out herein illustrates an exemplary embodiment of the invention and such exemplification is not to be construed as limiting the scope of the invention in any manner.

DETAILED DESCRIPTION

Figure 1:
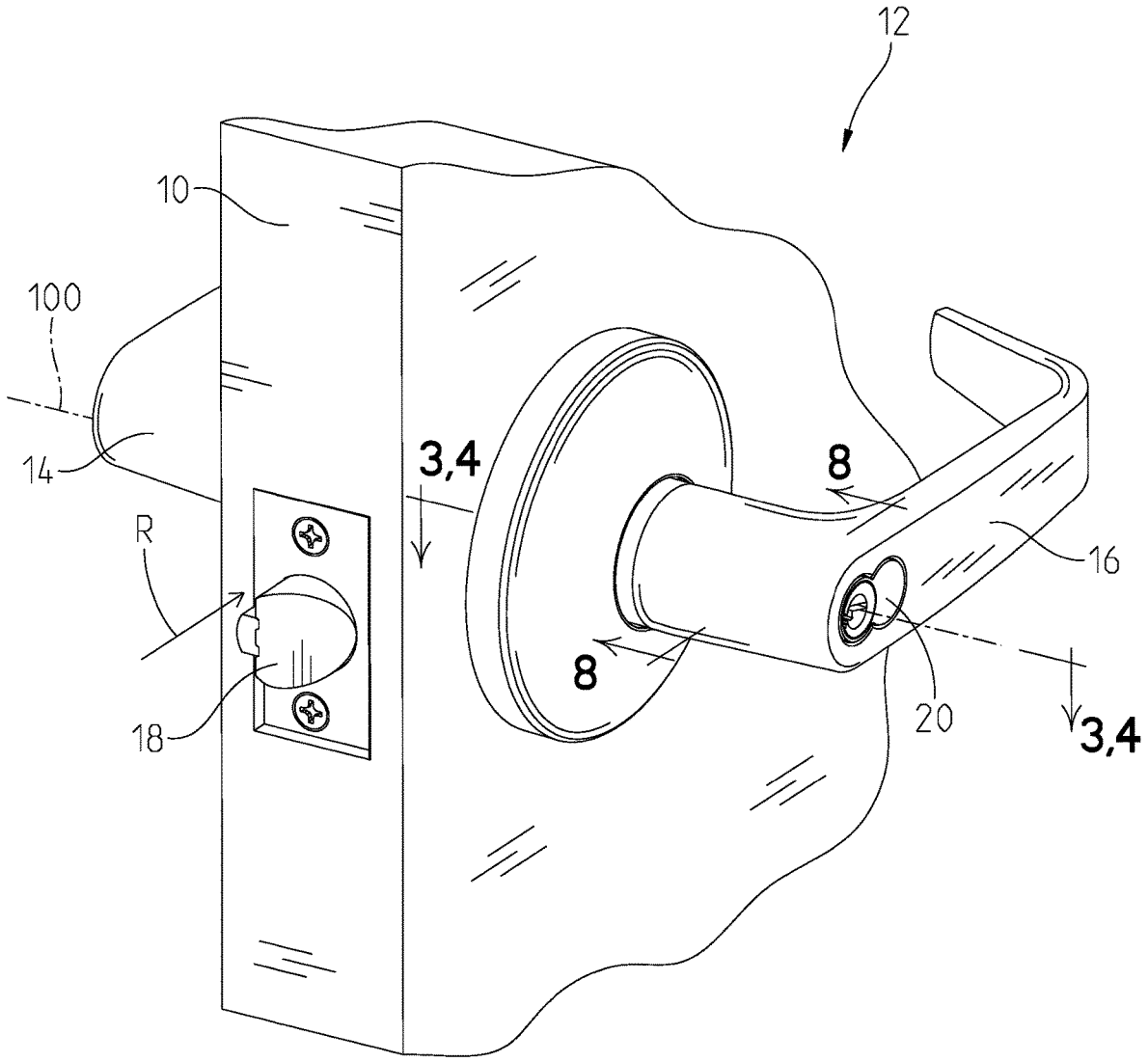
FIG. 1 is an illustration of a perspective view of a door lock mounted on a door, the door lock implementing a small format interchangeable core, in accordance with one embodiment of the present disclosure.

For the purposes of promoting an understanding of the principles of the present disclosure, reference is now made to the embodiments illustrated in the drawings, which are described below. The embodiments disclosed herein are not intended to be exhaustive or limit the present disclosure to the precise form disclosed in the following detailed description. Rather, the embodiments are chosen and described so that others skilled in the art may utilize their teachings. Therefore, no limitation of the scope of the present disclosure is thereby intended. Corresponding reference characters indicate corresponding parts throughout the several views.

The terms "couples", "coupled", "coupler" and variations thereof are used to include both arrangements wherein the two or more components are in direct physical contact and arrangements wherein the two or more components are not in direct contact with each other (e.g., the components are "coupled" via at least a third component), but yet still cooperate or interact with each other.

FIG. 1 illustrates door 10 having door lock 12. As illustrated, door lock 12 is exemplified as a cylindrical lock. Cylindrical locks are well known in the art; therefore, in the description that follows only certain details of the exemplary locks are described in detail, with the detailed description instead focusing on a stabilizer for use with small format interchangeable cores and associated methods of use.

As illustrated in FIG. 1, door lock 12 includes an egress actuator exemplified as egress operator actuatable input device 14. Door lock 12 further includes an ingress actuator exemplified as ingress operator actuatable input device 16. Operator actuatable input devices 14,16 may include handles, knobs, levers, or other suitable shapes for actuation by an operator. For the sake of brevity, operator actuatable input devices 14, 16 will be referred to herein as handles 14, 16. Door lock 12 is operably coupled to door 10. Door 10 is, in use, arranged to selectively allow and disallow ingress and egress from an area selectively covered by door 10. In an exemplification, door 10 can be hinged to a doorframe and can be selectively secured thereto by latch bolt 18, as is well known in the art. In an unlocked state of door lock 12, both egress handle 14 and ingress handle 16 can be actuated by an operator input motion, such as rotation about longitudinal axis 100 to move latch bolt 18 from a first or extended position illustrated in FIG. 1 to a second, retracted position along direction R allowing ingress and egress through door 10. When one of egress handle 14 and ingress handle 16 is actuated to move latch bolt 18 to the retracted position, door 10 may be moved relative to its doorframe to allow ingress and egress therethrough. Translation of rotational movement of egress handle 14 and ingress handle 16 to retraction of latch bolt 18 through a cam assembly 34 (see FIG. 4) is well known in the art and is therefore not described for the sake of brevity.

Door lock 12 is provided with removable lock core 20. Removable lock core 20 is selectively lockable to obstruct operator input motion from actuating latch bolt 18. Removable lock core 20 is removable and replaceable on door lock 12. Various door locks may be implemented including keyed and electronic. In the illustrated embodiment, removable lock core 20 defines a figure eight profile (see FIGS. 2 and 9) which is received in a corresponding figure eight profile of interior space 22 of handle 16 (see FIG. 2). The illustrated figure eight profile is known as a small format interchangeable core ("SFIC"). Removable lock core 20 may also be sized and shaped to be compatible with large format interchangeable cores ("LFIC") and other suitable core shapes.

Figure 9:
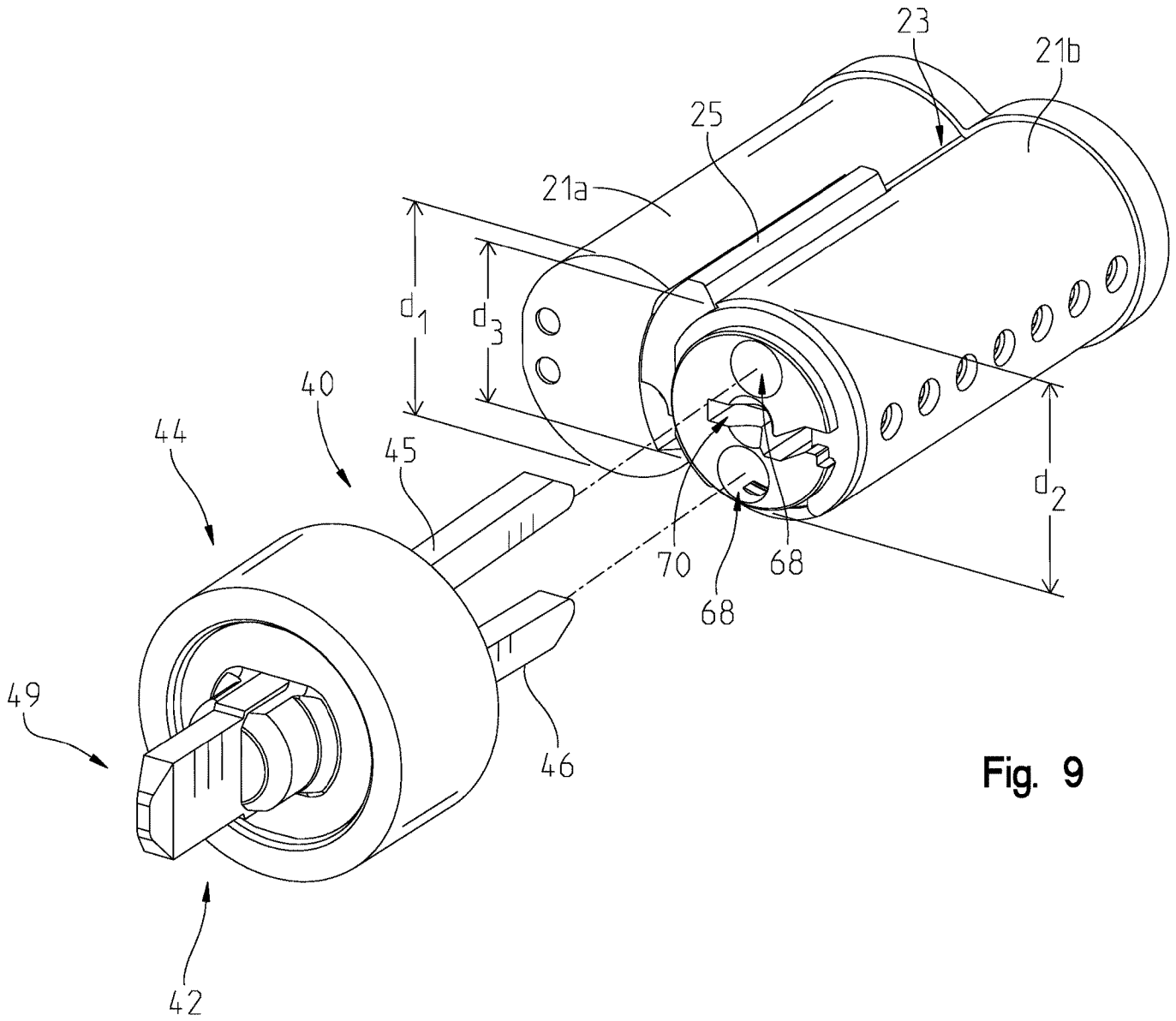
FIG. 9 is an illustration of an exploded view of a throw member and stabilizer exploded away from a removable core, in accordance with one embodiment of the present disclosure.

Referring to FIG. 9, removable lock core 20 includes upper portion 21*a* with a first maximum lateral extent (d1), lower portion 21*b* with a second maximum lateral extent (d2), and waist portion 23 having a third maximum lateral extent (d3). The third maximum lateral extent (d3) is less than the first maximum lateral extent (d1) and less than the second maximum lateral extent (d2). Exemplary interchangeable lock cores having a longitudinal shape satisfying the relationship of first maximum lateral extent (d1), second maximum lateral extent (d2), and third maximum lateral extent (d3) include small format interchangeable cores (SFIC), large format interchangeable cores (LFIC), and other suitable interchangeable cores. In alternative embodiments, removable lock core 20 may have longitudinal shapes that do not satisfy the relationship of first maximum lateral extent (d1), second maximum lateral extent (d2), and third maximum lateral extent (d3). Removable core 20 further includes a core keeper 25 that is operable to be moved between a first position and a second position. The first position allows removable lock core 20 to be removed from door lock 12. The second position restricts axial movement of removable lock core 20 along longitudinal axis 100. For example, core keeper 25 is received within a recess within a portion of handle 16 when core keeper 25 is in the second position, resulting in mechanical interference between the two components and limiting axial translation of removable lock core 20. Core keeper 25 may be actuated, for example, by a control key as is known in the art to retract core keeper 25 to the first position into the body of removable lock core 20 or at least out of the recess within the portion of the handle such that there is no longer a mechanical interference between core keeper 25 and handle 16. When in the first position, removable lock core 20 may be moved axially along longitudinal axis 100 and removed from handle 16. When removable lock core 20 is removed from handle 16, a handle retainer 30 may be actuated to remove handle 16 from the remainder of the door lock 12, as discussed herein.

Figure 2:
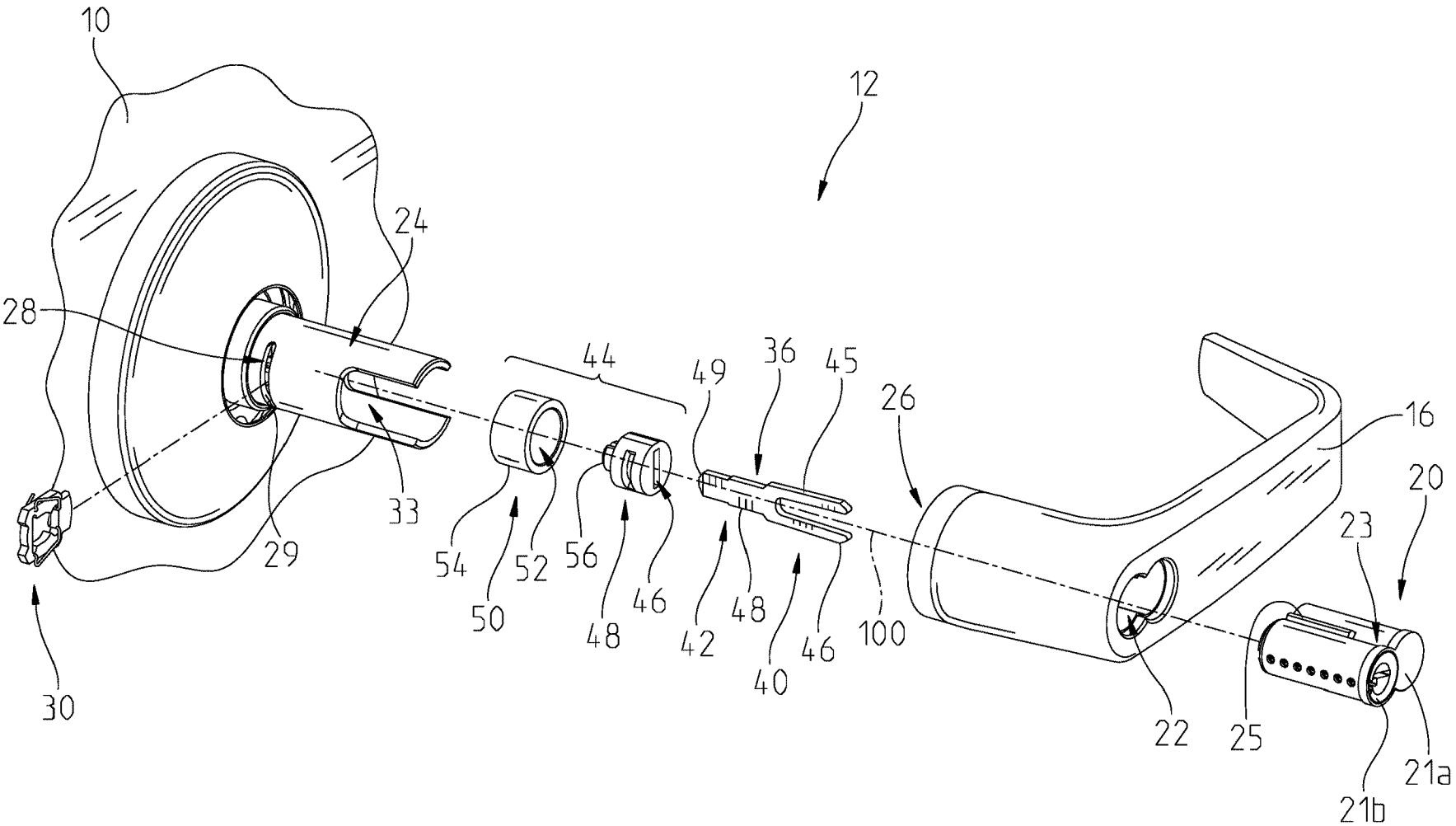
FIG. 2 is an illustration of an exploded view of a door lock implementing a small format interchangeable core, in accordance with one embodiment of the present disclosure.

Referring now to FIG. 2, one side of door lock 12 is illustrated and is shown in an exploded view. Handle 16 is illustrated including interior space 22 for receiving removable lock core 20. The profile of interior space 22 of handle 16 and the profile of removable lock core 20 correspond so as to allow removable lock core 20 to be removed from interior space 22 of handle 16, including while handle 16 is still secured to the remainder of door lock 12. For example, door lock 12 includes a sleeve or support 24 extending outward with which handle 16 engages, wherein support 24 supports handle 16 in a predetermined configuration. While handle 16 is secured to support 24, when removable lock core 20 is disengaged from handle 16, removable lock core 20 can be translated out from interior space 22 of handle 16. A replacement core may then be inserted into interior space 22 of handle 16 without removing handle 16 from support 24.

With further reference to the coupling between handle 16 and support 24, handle 16 includes open end 26. Open end 26 is operable to be receive support 24 into handle 16. When handle 16 and support 24 are coupled, handle 16 and support 24 have at least portions that are longitudinally overlapping, support 24 being positioned in open end 26 of handle 16. Handle 16 and support 24 are coaxially positioned relative to longitudinal axis 100, which also facilitates rotation of handle 16 with respect to support 24. Even when handle 16 is constrained from translational movement relative to support 24, handle 16 is operable to rotate relative to support 16 about longitudinal axis 100. In some embodiments, support 24 and handle 16 rotate together with respect to other components of door lock 12. The rotation of handle 16 by operator input can be transmitted from handle 16 to latch bolt 18.

Referring still to FIG. 2, support 24 includes aperture 28 in a wall 29 of support 24. Handle retainer 30 may be positioned in or through aperture 28. Handle 16 includes catch element 32 (see FIG. 3) which handle retainer 30 is operable to engage. When handle 16 is installed on support 24, handle retainer 30 is positioned in aperture 28 of support 24 and contacting catch element 32. Handle retainer 30, when received in catch element 32, is operable to provide mechanical interference to limit axial movement of handle 16 relative to support 24. Catch element 32 may include various structures or combinations of structures, including but not limited to recesses and protrusions, for engaging with handle retainer 30. In order to disengage handle retainer 30 from handle 16, handle retainer 30 is translated along axis 102 (see FIG. 3) away from catch element 32 of handle 16, releasing handle 16 from engagement. Handle 16 may then be translated along longitudinal axis 100 away from support 24. Handle retainer 30 will be discussed in further detail with respect to other components. However, handle retainer 30 may include any shape or form operable to limit axial translation between handle 16 and support 24 along longitudinal axis 100. For example, handle retainer 30 may include a pin or pins, slats, and so forth.

Figure 3:
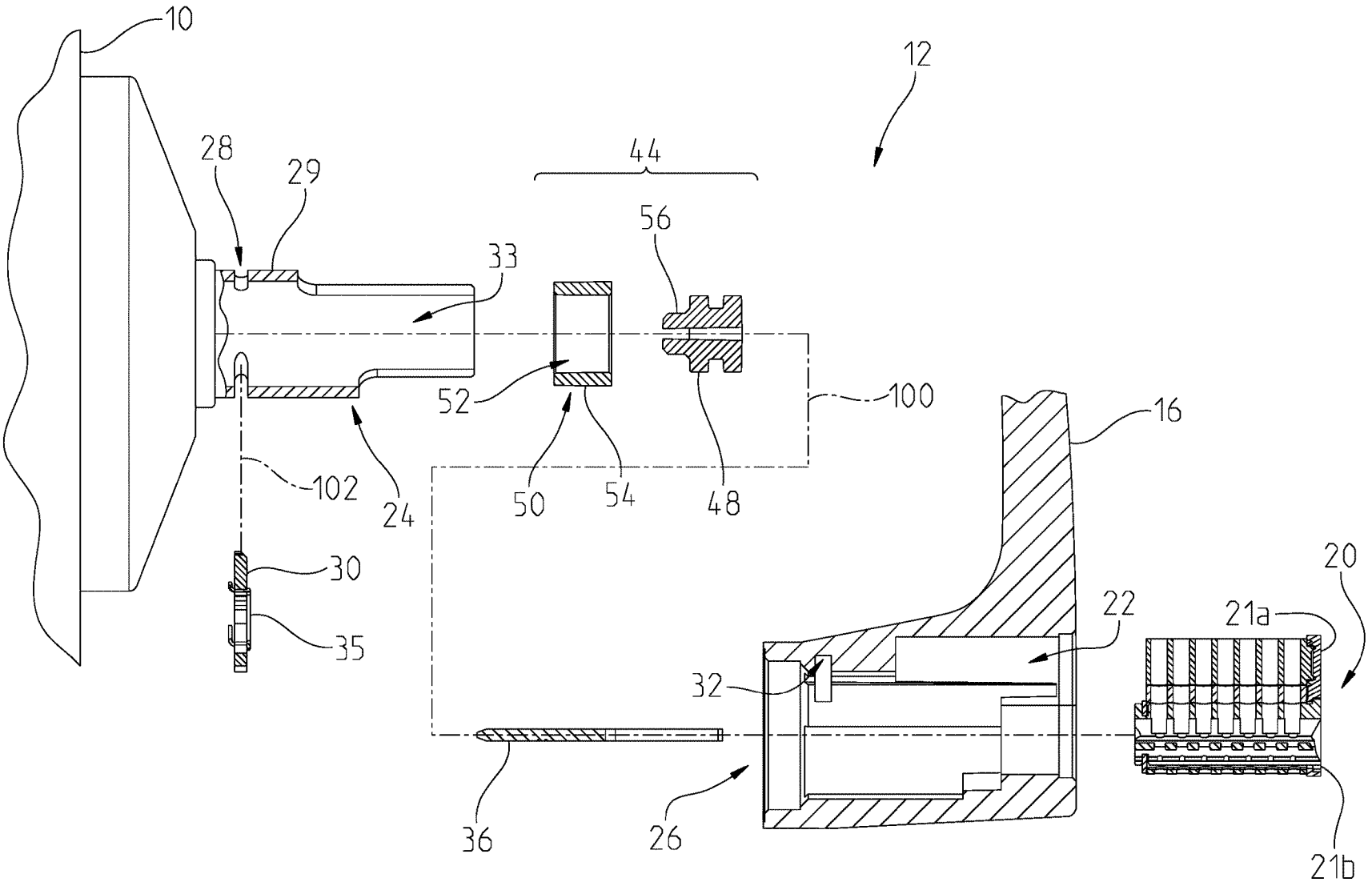
FIG. 3 is an illustration of an exploded side view of a door lock, where some of the components of the door lock are sectioned, the door lock including a removable core, a throw member, and a stabilizer, wherein a handle is operable to be coupled to a support, in accordance with one embodiment of the present disclosure.
Figure 4:
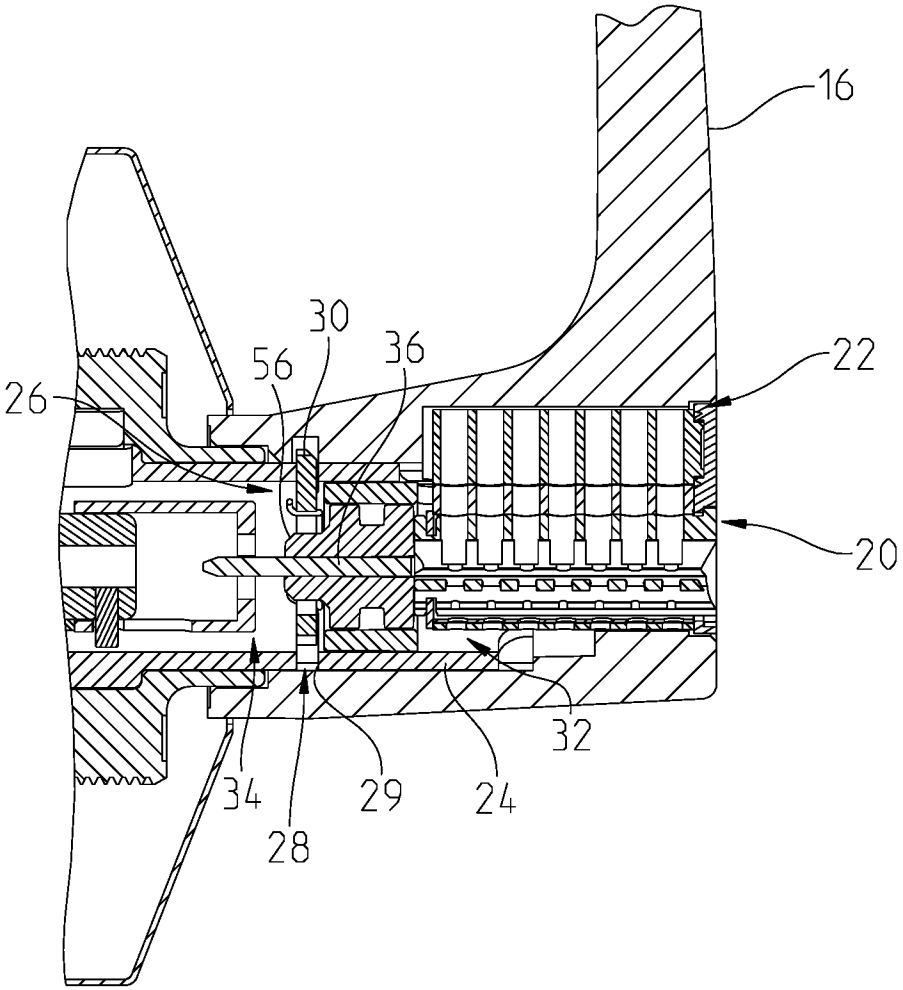
FIG. 4 is an illustration of side view of a sectioned door lock including a cam assembly and a removable core with a throw member extending therebetween, the door lock including an interior space with a stabilizer positioned therein for stabilizing a throw member extending between the removable core and the cam assembly, the throw member operable to transmit rotation of handle to cam assembly, in accordance with one embodiment of the present disclosure.

Referring now to FIGS. 2-4, support 24 may include interior space 33 for housing components of door lock 12. For example, at least a portion of removable lock core 20 may be positioned in interior space 33 of support 24 (see FIG. 4). Although components and operation of cam assembly 34 are not discussed in detail herein (See FIG. 4, in which a portion of cam assembly 34 is illustrated), at least a portion of cam assembly 34 is positioned in interior space 33 of support 24. Cam assembly 34 is operable to transmit operator input motion from handle 16 and/or removable lock core 20 about longitudinal axis 100 to actuate latch bolt 18. Interior space 33 may further house, at least in part, a throw member 36. Throw member 36 is operatively coupled to removable lock core 20 and cam assembly 34. As removable lock core 20 is actuated by a key or handle 16 (when unlocked), throw member 36 is likewise actuated and transmits the operator input motion to cam assembly 34.

Throw member 36 includes any number of configurations and is understood to include any member that operatively couples the removable lock core 20 and cam assembly 34 for transmitting operator input motion to cam assembly 34. In one example illustrated, throw member 36 includes core interface portion 40 and cam interface portion 42. Core interface portion 40 of throw member 36 is operable to interface with removable lock core 20 in a fixed rotational relationship, thus allowing rotation of removable lock core 20 to result in rotation of throw member 36. Core interface portion 40, in some embodiments, includes first prong 45 and second prong 46, each prong 45, 46 being received by removable lock core 20 (see FIG. 9). Prongs 45, 46 may include rods, pins, slats, or any configuration operable to interface with removable lock core 20, where prongs 45, 46 extend outward from body of throw member 36. Cam interface portion 42 of throw member 36 is operable to interface with cam assembly 34 in a fixed rotational relationship, thus allowing rotation of throw member 36 to result in rotation of at least a portion of cam assembly 34. Cam interface portion 42, in some embodiments, includes slat 49 operable to be received by cam assembly 34. In some embodiments, throw member 36 is universal in that cam interface portion 42 is interchangeable to allow for coupling of throw member 36 to any cam assembly 34. Regardless, cam interface portion 42 includes any structure that is operable to interface with cam assembly 34.

As removable lock core 20 is removed and reassembled in door lock 12 (either a new removable core, or the same removable core), core interface portion 40 of throw member 36 must align with removable lock core 20 for removable lock core 20 to be properly installed and for door lock 12 to appropriately function. In order to assist in alignment of throw member 36 and removable lock core 20, a stabilizer 44 is provided. Stabilizer 44 is operable to retain to throw member 36 in a coupling orientation. For example, in some embodiments throw member 36 is positioned along longitudinal axis 100 both for coupling and in operation. Stabilizer 44 is operable to retain throw member 36 along longitudinal axis 100 regardless of whether removable lock core 20 is present or absent. In some embodiments, stabilizer 44 is positioned about at least a portion of throw member 36 (see FIGS. 5-7). Stabilizer 44 may be installed onto throw member 36, may be manufactured onto throw member 36, or may be integral with throw member 36. In some embodiments, stabilizer includes slot 46 which receives throw member 36 (see FIG. 2).

Once stabilizer 44 is positioned on throw member 36, stabilizer 44 is operable to improve stability of throw member 36 prior to interfacing of throw member 36 and removable lock core 20. In some embodiments, stabilizer 44 is operable to contact interior walls of door lock 12 (e.g. interior walls of support 24 forming interior space 33). As stabilizer 44 contacts the interior walls, stabilizer 44 helps maintain throw member 36 in a predetermined orientation. For example, stabilizer 44 maintains throw member 36 along longitudinal axis 100. Furthermore, stabilizer 44 helps reduce throw member 36 from being off axis. This can occur when throw member 36 is supported only by cam assembly 34 at one end of throw member 36, and because throw member 36 is supported only at one end, gravity can cause the throw member 36 to sag, especially when the interface between cam assembly 34 and throw member 36 is only a loose interface. Stabilizer 44 provides support to throw member 36 independent from or in conjunction with interface between cam assembly 34 and throw member 36. In some embodiments stabilizer 44 is positioned near or around the center of mass of throw member 36 such that gravitational forces on core interface portion 40 and cam interface portion 42 are substantially balanced, reducing the tendency of the throw member 36 to be moved out of alignment with or at an angle to the predetermined position of throw member 36 (e.g., in alignment with longitudinal axis 100). The fit of stabilizer 44 with the interior walls of door lock 12 may be such that throw member 36 is retained in the predetermined position even when the center of mass of throw member 36 is not surrounded by stabilizer 44. The interior walls of door lock 12 may be formed, for example, by support 24. Thus, stabilizer 44 may be engaged with support 24 when positioned in interior space 33 of support 24.

In some embodiments, stabilizer 44 is dimensioned to substantially match a circumferential profile of a portion of removable lock core 20 (e.g., lower portion 21*b*). When stabilizer 44 and removable lock core 20 are positioned together (e.g., die cast, over molded, installed, bonded, and so forth) and are installed in door lock 12, stabilizer 44 is positioned posterior of lower portion 21*b* of removable lock core 20, and in some embodiments against lower portion 21*b* of removable lock core 20. In embodiments, a minimum outer lateral extent of stabilizer 44 is equal to d2 of removable lock core 20. In embodiments, a minimum outer lateral extent of interior space 33 is greater than d2 of removable lock core 20. The outer lateral extent of interior space 33, in embodiments, is symmetrical about longitudinal axis 100. The outer lateral extent of interior space 33, in embodiments, is asymmetrical about longitudinal axis 100. Furthermore, stabilizer 44 may be dimensioned so as to be removable through the opening in the front of handle 16 that removable lock core 20 is removed.

In some embodiments, stabilizer 44 includes first stabilizer member 48 and second stabilizer member 50. First stabilizer member 48 may interface with throw member 36 as previously described with respect to stabilizer 44 as a whole. Second stabilizer member 50 includes interior space 52 which is dimensioned to receive first stabilizer member 48 and outer wall 54 for interfacing with the interior walls of door lock 12. In some embodiments, second stabilizer member 50 is a bushing. First stabilizer member 48 and second stabilizer member 50 may be implemented when the interior walls of door lock 12 (e.g. interior walls of support 24 forming interior space 33) have a dimension greater than d2 of removable lock core 20. This allows first stabilizer member 48 to be dimensioned to be removable through interior space 22 of handle 16 when removable lock core 20 has been removed, allowing throw member 36 and a portion of stabilizer 44 to be removed from door lock 12 while handle 16 is still installed. Further, stabilizer 44 retains the stabilizing functionality because second stabilizing member 50 retains first stabilizing member 48 and, consequently, throw member 36, in the predetermined orientation when first stabilizing member 48 is positioned at least partially within second stabilizing member 50. Because the second stabilizer member 50 includes a profile to engage interior walls of door lock 12, first stabilizer member 48 is stabilized within second stabilizer member 50, which effectively stabilizes throw member 36. In these embodiments implementing first and second stabilizer members 48,50, first stabilizer member 48 may be dimensioned to substantially match a circumferential profile of a portion of removable lock core 20 (e.g., lower portion 21*b*). When first stabilizer member 48 and removable lock core 20 are installed in door lock 12, first stabilizer member 48 is positioned posterior of lower portion 21*b* of removable lock core 20, and in some embodiments against lower portion 21*b* of removable lock core 20. The term "posterior" in this instance refers to a position away from the referenced structure, and in some instances toward the longitudinal center of door lock 12.

Referring to FIG. 4, stabilizer 44 is installed with door lock 12. More specifically, stabilizer 44 is positioned at least partially within interior space 33 of support 24 between removable lock core 20 and cam assembly 34. In some embodiments, stabilizer 44 is installed between lower portion 21*b* of removable lock core 20 and handle retainer 30, substantially filling interior space 33 between a back plane of lower portion 21*b* of removable lock core 20 and handle retainer 30. The term "substantially fill" refers to the discussed space being occupied to minimize spaces to have at least one of the dimensions being less ¼ of the diameter of the discussed space. Because of manufacturing tolerances, manufacturing techniques, or material/weight conservation, it is understood that when stabilizer 44 and throw member 36 are positioned in interior space 33, there may be gaps provided and therefore is not completely filled. However, the term "substantially fill" does refer to having a majority of the volume of the discussed space being occupied by another component.

In those embodiments where handle retainer 30 is positioned between cam assembly 34 and removable lock core 20, handle retainer 30 includes central aperture 31 through which throw member 36 extends. The profile of central aperture 31 of handle retainer 30 may include any number of shapes operable to accommodate throw member 36 and, in some embodiments, rotation of throw member 36 within central aperture 31. Likewise, stabilizer 44 may rotate within central aperture 31 of handle retainer 30 with throw member 36 along longitudinal axis 100. The profile of stabilizer 44 is such that stabilizer 44 is operable to rotate along longitudinal axis 100 within support 24. Furthermore, in those embodiments implementing first and second stabilizer members 48, 50, first and second stabilizer members 48, 50 are operable to rotate relative to one another within support 24.

Figure 6:
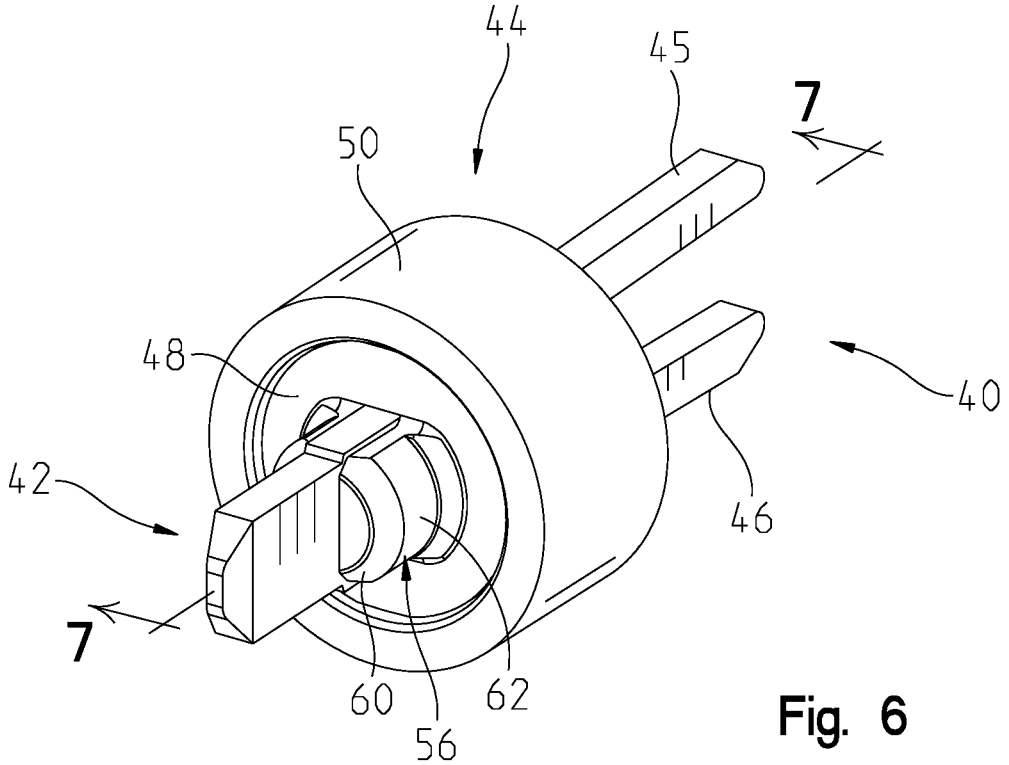
FIG. 6 is an illustration of an alternative perspective view of the stabilizer and throw member, in accordance with the embodiment illustrated in FIG. 5.
Figure 8:
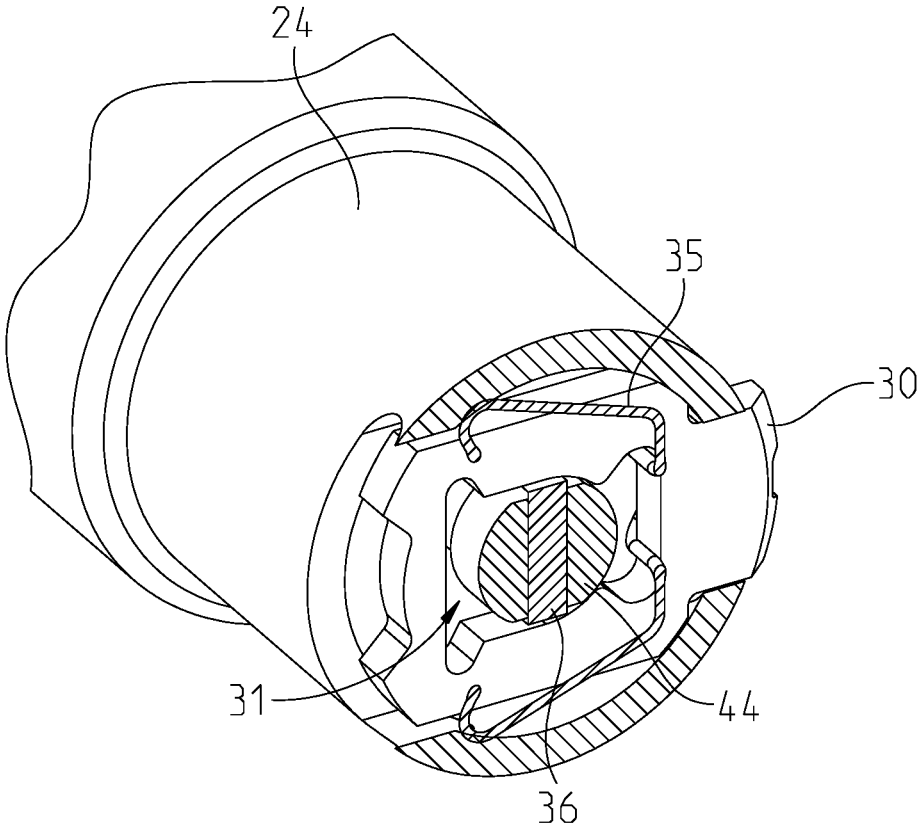
FIG. 8 is an illustration of a sectioned view of a portion of a door lock, the door lock including a support sectioned to demonstrate a retainer positioned in the support with a throw member and stabilizer positioned in a central aperture of the retainer, in accordance with one embodiment of the present disclosure.

In some embodiments, the body of stabilizer 44 may further include longitudinal extension 56 (see FIG. 6). When stabilizer is installed on door lock 12, longitudinal extension 56 extends into central aperture 31 of handle retainer 30 (see FIG. 4). Longitudinal extension 56, in some embodiments, contacts or interfaces with handle retainer 30. For example, FIG. 8 illustrates handle retainer 30 positioned partially in aperture 28 through wall 29 of support 24. Handle retainer 30 includes biasing member 35 operable to bias handle retainer 30 relative to support 24, biasing member 35 biasing handle retainer 30 toward an engaged configuration which is operable to retain handle 16 with support 24 as previously described. When handle retainer 30 is positioned in the engaged configuration, at least a portion of longitudinal extension 56 may be positioned through central aperture of handle retainer 30. Longitudinal extension 56 may contact handle retainer 30 such that handle retainer 30 provides further stability to stabilizer 44 and, by extension, to throw member 36. Longitudinal extension 56 does not necessarily need to be in constant contact with handle retainer 30, but may contact handle retainer 30 if throw member 36 moves or pivots away from longitudinal axis 100. In some embodiments, handle retainer 30 provides mechanical resistance against deflection of throw member 36 away from longitudinal axis 100. This provides further stability to throw member 36 especially when removable lock core 20 is being installed onto door lock 12. Furthermore, longitudinal extension 56 of stabilizer 44 may also provide mechanical interference against movement of handle retainer 30 along longitudinal axis 100 (see FIG. 3), especially when throw member 36 is engaged with cam assembly 34 (see FIG. 4) and removable lock core 20. This minimizes risk of retainer from inadvertently disengaging from handle 16 and/or support 24, even during operation.

Figure 5:
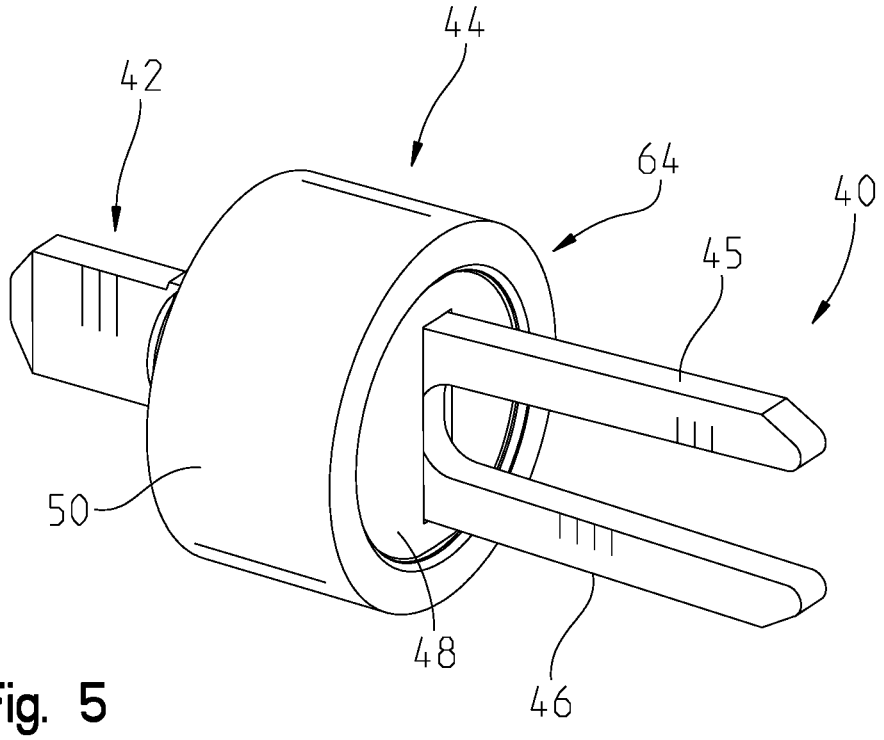
FIG. 5 is an illustration of a perspective view of a stabilizer positioned surrounding at least a portion of a throw member, in accordance with one embodiment of the present disclosure.

With further reference to FIGS. 5 and 6, throw member 36 and stabilizer 44 are illustrated in greater detail. Stabilizer 44 is positioned between core interface portion 40 and cam interface portion 42. Stabilizer 44 is illustrated as having a cylindrical outer dimension, however, any profile to appropriately interface support 24 for providing stability to throw member 36 is contemplated herein. Prongs 45, 46 may be tapered to help facilitate insertion of the prongs into removable lock core 20 during installation of removable lock core 20. As shown in FIGS. 5 and 6, first and second stabilizer member 48, 50 are concentrically disposed. Because both first and second stabilizer members 48, 50 have cylindrical profiles, first and second stabilizer members 48, 50 are operable to be rotated relative to each other as well as relative to support 24 within which they are positioned. As illustrated in FIG. 5, longitudinal extension 56 may include a leading edge 60 that is tapered to help center longitudinal extension 56 as longitudinal extension 56 is being inserted into central aperture 31 or handle retainer 30. Longitudinal extension 56 is shown as having cylindrical outer walls 62 past tapered leading edge 60. However, it is contemplated that longitudinal extension 56 may have outer walls 62 that are cylindrical along the full length of longitudinal extension 56 or that outer walls 62 are tapered along the full length of longitudinal extension 56.

Referring again to FIG. 5, stabilizer 44 may include a substantially flat anterior surface 64. Anterior surface 64 may be positioned against or adjacent to at least a back portion of removable lock core 20 (e.g., against or adjacent to lower portion 21*b*). In some embodiments the first stabilizer member 48 may include a profile that is smaller or equal to second maximum lateral extent (d2) of lower portion 21*b* of removable lock core 20. As previously disclosed, in some embodiments stabilizer 44 is positioned about the center of mass of throw member 36, combination of throw member 36 and stabilizer 44, or both. Although illustrated as having first and second stabilizer member 48, 50, as previously disclosed, stabilizer 44 may be one piece. Also, as previously disclosed, stabilizer 44 may be integral with throw member 36.

Figure 7:
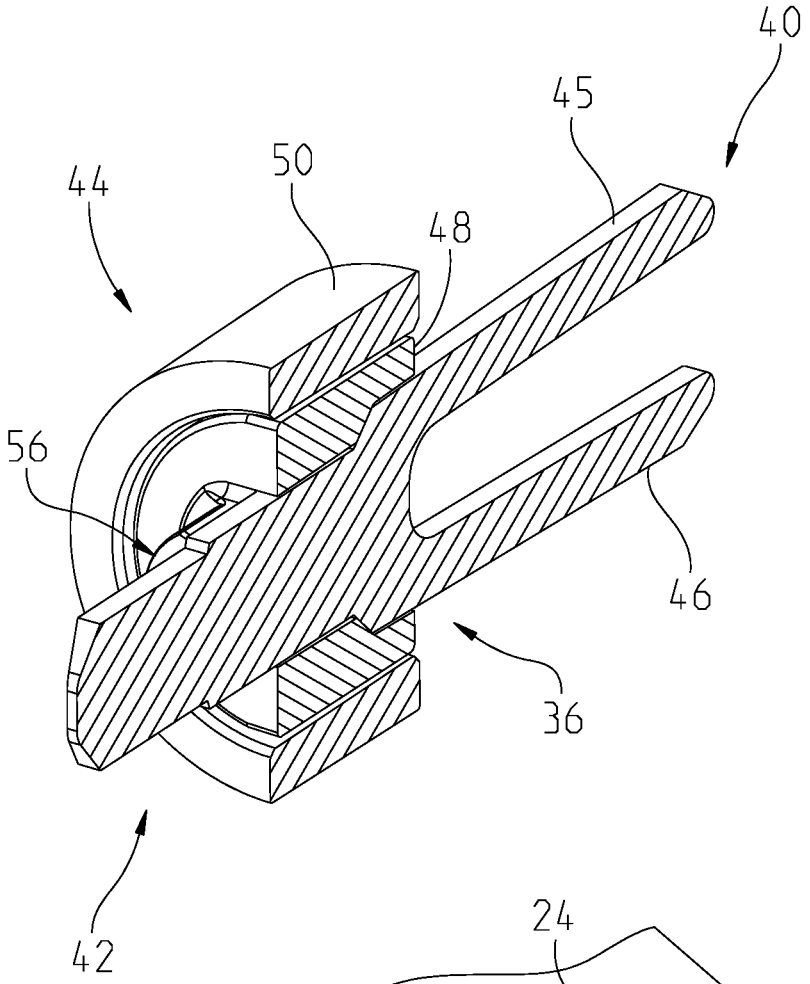
FIG. 7 is an illustration of a sectioned view of the stabilizer and throw member, in accordance with the embodiment illustrated in FIGS. 5 and 6.

Referring now to FIG. 7, throw member 36 may be inserted into stabilizer 44. Thus, stabilizer 44 may be implemented on existing door lock 12 as a retrofit component, the stabilizer 44 installable onto throw member 36 and into door lock 12. A retrofit kit may also include a new throw member 36 with stabilizer 44. It is also disclosed that throw member 36 and stabilizer 44 may be an integral unit, or alternatively first stabilizer member 48 and throw member 36 may be integrally formed and second throw member 50 is provided with the integral throw member/first stabilizer member unit.

Figure 10:
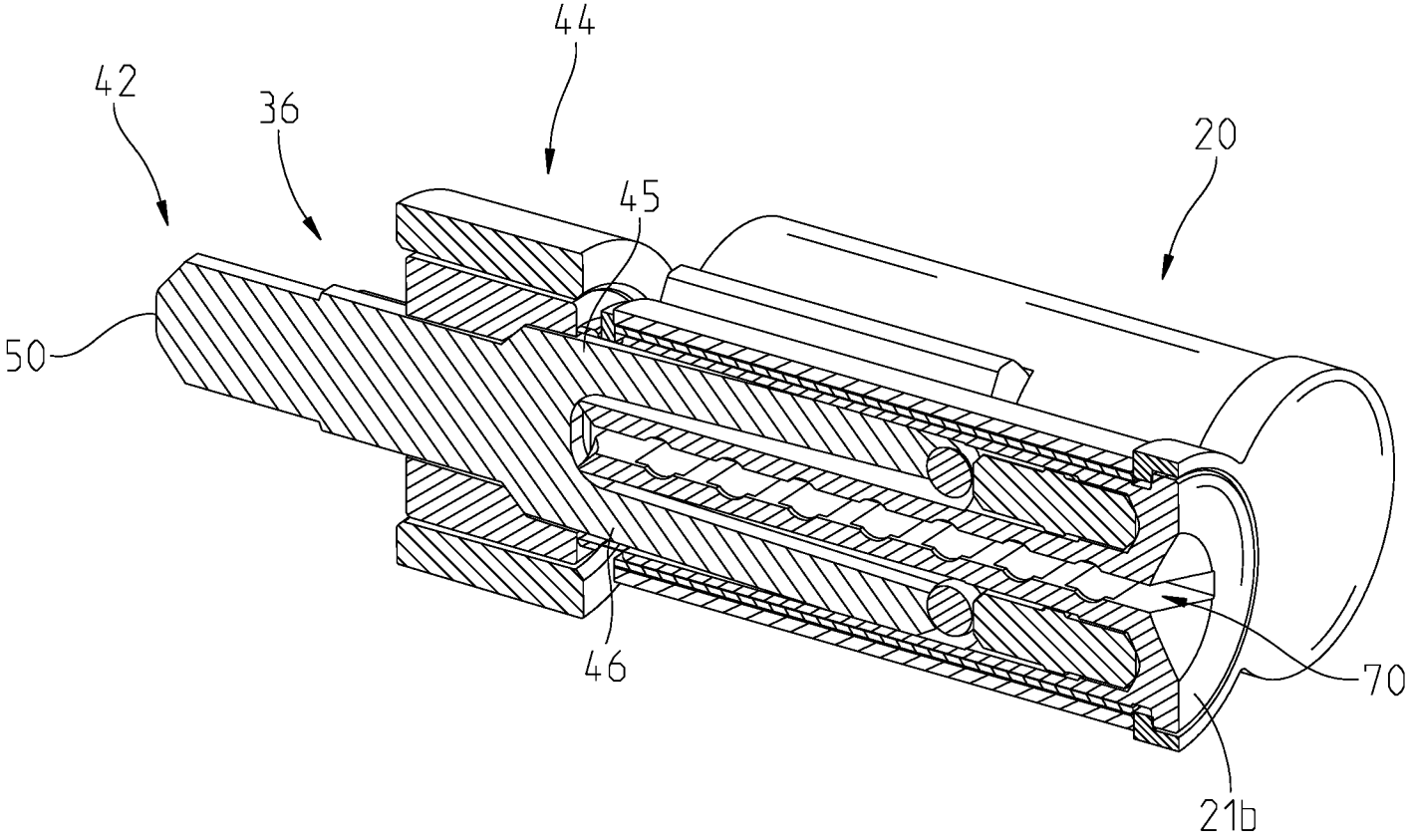
FIG. 10 is an illustration of a section view of a throw member and stabilizer positioned with a removable core, in accordance with one embodiment of the present disclosure.

Referring to FIG. 9, interfacing of throw member 36 with removable lock core 20 is illustrated in greater detail. Removable lock core 20 includes receivers 68 into which core interface portion 40 may be received. More specifically, throw member 36 includes first prong 45 and second prong 46 which are each received into respective receivers 68. In some embodiments, removable lock core 20 includes key slot 70 that is open at posterior side of removable lock core 20, the posterior side being the side inserted into door lock 12. As previously discussed, when stabilizer 44 is positioned on throw member 36, and throw member 36 and removable lock core 20 are installed in door lock 12, stabilizer 44 is positioned adjacent to the back plane of removable lock core 20. FIG. 10 provides an illustration of prongs 45, 46 positioned in each respective receiver 68 of removable lock core 20.

Figure 11:
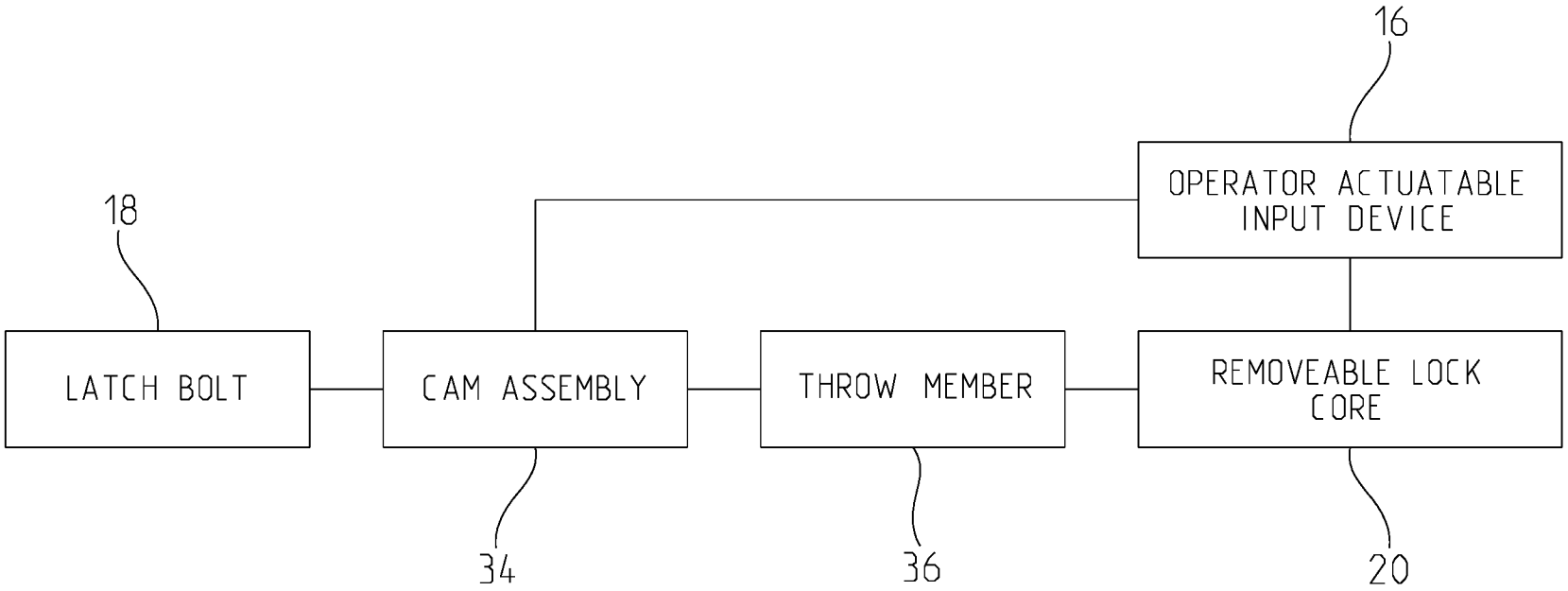
FIG. 11 is a schematic of a door lock.

Referring to FIG. 11, a representative view of portions of door lock 12 are illustrated. As discussed herein latch bolt 18 is operatively coupled to cam assembly 34 such that cam assembly 34 can cause a movement of latch bolt 18. Cam assembly 34 may be actuated by one or both of removable lock core 20 and operator actuatable input device 16 through throw member 36, such as in the disclosed cylindrical lockset or may be actuated by operator actuatable input device 16 independent of removable lock core 20, such as in a mortise lockset.

In some instances throughout this disclosure and in the claims, numeric terminology, such as first, second, third, and fourth, is used in reference to various components or features. Such use is not intended to denote an ordering of the components or features. Rather, numeric terminology is used to assist the reader in identifying the component or features being referenced and should not be narrowly interpreted as providing a specific order of components or features.

While this invention has been described as having exemplary designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

I claim:

1. A cylindrical door lock comprising:

a latch bolt moveable between a first position operable to limit ingress and egress and a second position operable to permit ingress and egress;

a cam assembly operable to move the latch bolt from the first position to the second position;

a support at least partially surrounding the cam assembly;

an operator actuatable input device having an open end, the support being received in the open end, the operator actuatable input device being operatively coupled to the latch bolt through the cam assembly to transition the latch bolt from the first position to the second position;

a retainer coupling the operator actuatable input device to the support, the retainer being moveable between a hold position wherein the operator actuatable input device is coupled to the support and a remove position wherein the operator actuatable input device is translatable relative to the support;

a removable lock core positioned at least partially within the operator actuatable input device;

a throw member operatively coupled with the lock core and the cam assembly to actuate the cam assembly based on a position of the operator actuatable input device; and a stabilizer comprising a body, the stabilizer positioned at least partially within the support and posterior to the lock core;

wherein the retainer includes a central opening, a portion of the body of the stabilizer being positioned in the central opening of the retainer.

2. The cylindrical door lock of claim 1, wherein the retainer supports the body of the stabilizer such that the throw member is maintained in a predetermined orientation.

3. The cylindrical door lock of claim 1, wherein the throw member and the stabilizer extend through the central opening and the throw member and the stabilizer are operable to rotate about a longitudinal axis within the central opening.

4. The cylindrical door lock of claim 1, wherein the stabilizer includes a bushing including a central aperture, the bushing operable to receive at least a portion of the stabilizer in the central aperture.

5. The cylindrical door lock of claim 4, wherein the body of the stabilizer includes a first portion and a second portion, the first portion having first diameter and the second portion having a second diameter, the first portion operable to be positioned in the central aperture of the bushing and the second portion operable to be positioned in the central opening of the retainer.

6. The cylindrical door lock of claim 4, wherein the stabilizer, including the bushing, and at least a portion of the throw member are operable to be positioned between the lock core and the retainer.

7. The cylindrical door lock of claim 6, wherein the stabilizer, including the bushing, and the throw member substantially fill an interior of the support at a cross section of the support at a longitudinal position between the lock core and the retainer.

8. The cylindrical door lock of claim 1, wherein a bushing of the stabilizer engages with the support so as retain the throw member along a longitudinal axis during assembly of the cylindrical door lock.

9. The cylindrical door lock of claim 8, wherein the stabilizer is operable to retain the throw member in a predetermined configuration to engage the lock core when the lock core is installed.

10. The cylindrical door lock of claim 1, wherein when the portion of the body of the stabilizer is positioned in the central opening of the retainer, the stabilizer is operable to provide mechanical resistance against movement of the retainer from the engaged position to the disengaged position.

11. The cylindrical door lock of claim 1, wherein the body of the stabilizer is operable to be positioned to contact the retainer.

12. A stabilizer for a cylindrical door lock mounted to a door, the cylindrical door lock including a support, an operator actuatable input device at least partially surrounding the support, a retainer being moveable between an engaged position in which the retainer engages the support and the operator actuatable input device to limit axial translation of the operator actuatable input device relative to the support and a disengaged position in which the retainer permits axial translation of the operator actuatable input device relative to the support, a removable lock core positioned at least partially within the operator actuatable input device, a latch bolt moveable between an engaged position operable to limit ingress and egress and a disengaged position operable to permit ingress and egress, and a cam assembly operable to transition the latch bolt between the engaged position and the disengaged position, the stabilizer comprising:

a body operable to be positioned at least partially within the support and posterior to the lock core, the body positioned in the retainer when the retainer is in the engaged position to provide mechanical resistance against the retainer to limit movement of the retainer from the engaged position to the disengaged position.

13. The stabilizer of claim 12, further comprising a throw member extending from the body, the throw member operable to engage with the lock core and the cam assembly, the throw member operable to transmit user input received at the lock core to the cam assembly.

14. The stabilizer of claim 13, wherein the throw member and the body are formed as an integral unit.

15. The stabilizer of claim 13, wherein the body is bonded to the throw member.

16. The stabilizer of claim 13, further comprising a bushing including a central aperture, the bushing operable to receive at least a portion of the stabilizer in the central aperture.

17. The stabilizer of claim 16, wherein the bushing, the body, and at least a portion of the throw member are operable to be positioned between the lock core and the retainer.

18. The stabilizer of claim 17, wherein the bushing, the body, and the throw member substantially fill at least a portion of an interior space formed in the support at a longitudinal position between the lock core and the retainer.

19. The stabilizer of claim 18, wherein the bushing is shaped to engage an interior surface of the support when positioned in the interior space of the support, the bushing and the body retained within the support such that the throw member is maintained in a predetermined orientation to engage the lock core when the lock core is installed.

* * * * *